US008073182B2

(12) United States Patent
Li et al.

(10) Patent No.: US 8,073,182 B2
(45) Date of Patent: Dec. 6, 2011

(54) MOUNTING APPARATUS FOR SPEAKER

(75) Inventors: Wen-Bo Li, Shenzhen (CN); Yang Xiao, Shenzhen (CN); Hai-Shan Sun, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 517 days.

(21) Appl. No.: 12/347,340

(22) Filed: Dec. 31, 2008

(65) Prior Publication Data

US 2010/0040253 A1 Feb. 18, 2010

(30) Foreign Application Priority Data

Aug. 15, 2008 (CN) ..... 2008 2 0301837

(51) Int. Cl.
*H04R 1/02* (2006.01)

(52) U.S. Cl. ..... 381/386

(58) Field of Classification Search ..... 381/86, 381/87, 388, 392, 189, 150–152, 160–167, 381/184–186, 361, 366, 386; 455/350; 181/199
See application file for complete search history.

*Primary Examiner* — Jarrett Stark
*Assistant Examiner* — Lawrence Tynes, Jr.
(74) *Attorney, Agent, or Firm* — Altis Law Group, Inc.

(57) ABSTRACT

A mounting apparatus for mounting a speaker to a computer case, includes a base plate assembled on the computer case, a fixing member configured to fix two corners on a top edge of the speaker, and an elastic sheet configured to fix a bottom edge of the speaker.

14 Claims, 2 Drawing Sheets

MOUNTING APPARATUS FOR SPEAKER

BACKGROUND

1. Technical Field

The present invention relates to a mounting apparatus for mounting a speaker to a computer case.

2. Description of Related Art

A speaker is typically mounted to a computer case with screws, using a tool, which is very inconvenient and time-consuming in a factory assembly line.

Therefore, a new mounting apparatus for mounting a speaker to a computer case is desired to overcome the above-described deficiencies.

DETAILED DESCRIPTION OF THE EMBODIMENTS

Figure 1:
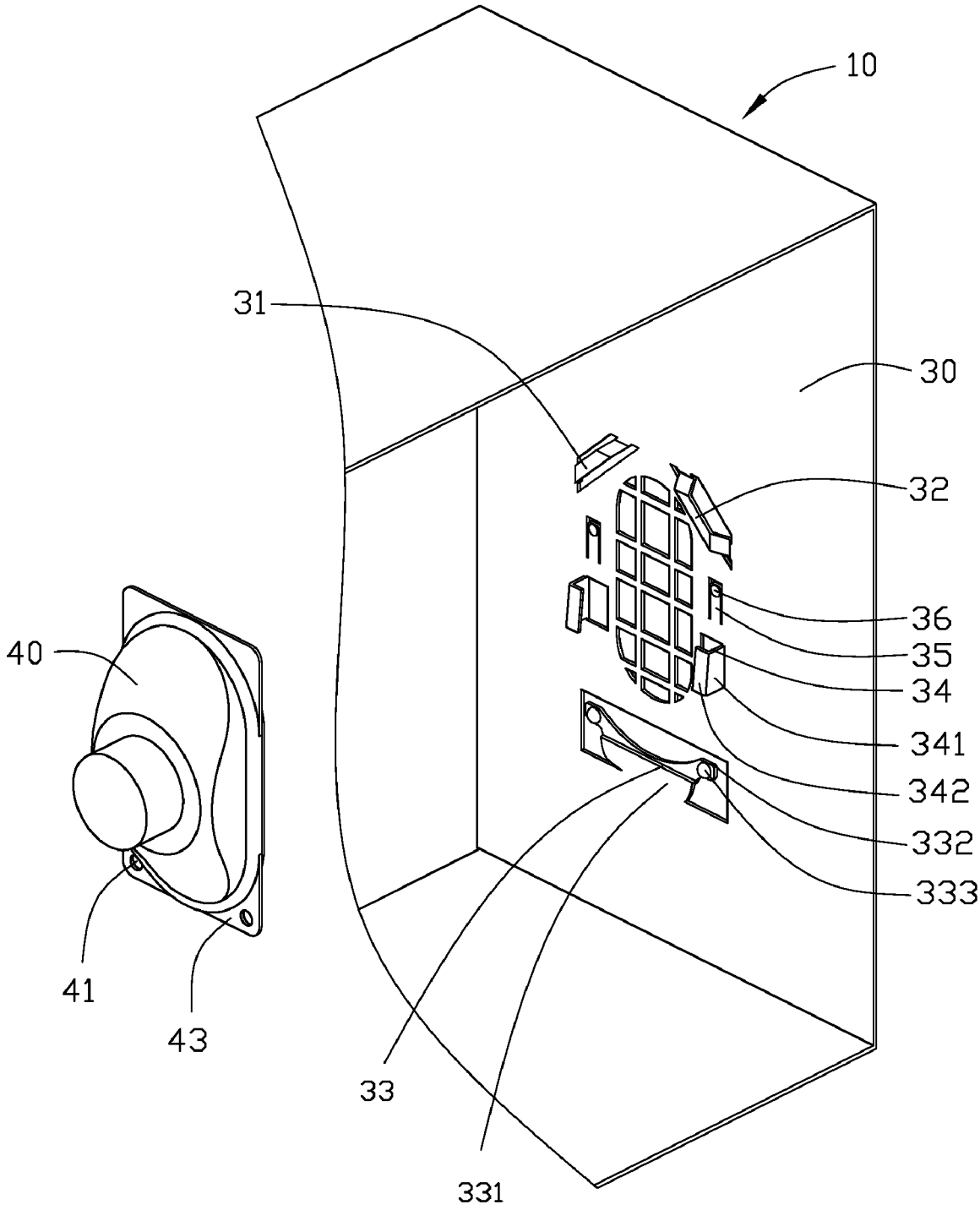
FIG. 1 is an exploded view of an embodiment of a mounting apparatus for mounting a speaker to a computer case.
Figure 2:
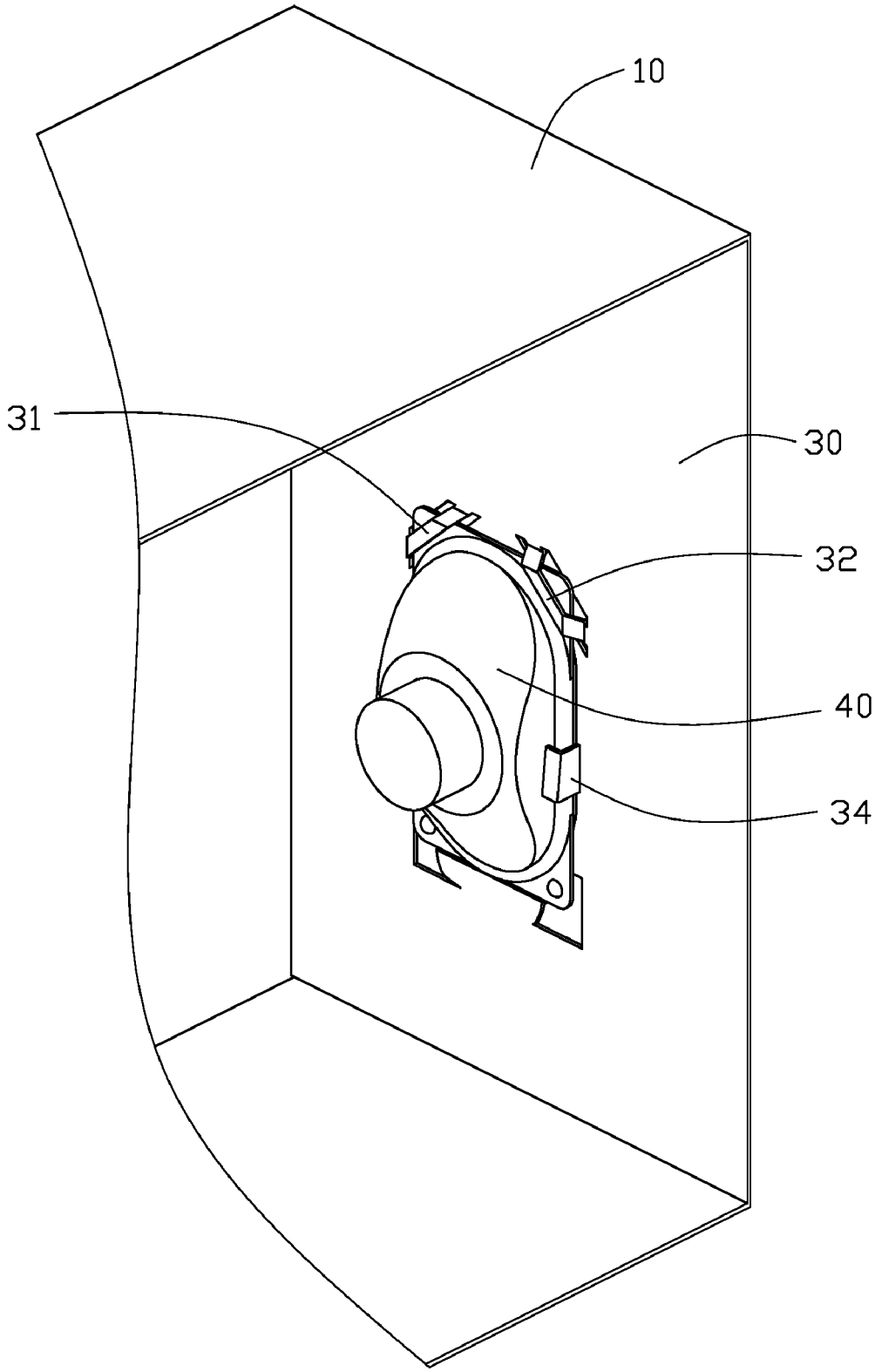
FIG. 2 is an assembled view of the mounting apparatus of FIG. 1.

Referring to FIGS. 1 and 2, an embodiment of a mounting apparatus for mounting a speaker 40 to a computer case 10 includes a base plate 30. Two fixing sheets 31, 32 protrude from an inner surface adjacent to one side of the base plate 30, and an elastic sheet 33 protrudes from the inner surface adjacent to another side of the base plate 30.

The fixing sheets 31, 32 are oriented at an angle from the elastic sheet 33. The elastic sheet 33 includes a main body 331, and a pair of elastic arms 332 extending from opposite sides of the main body 331. A salient point 333 is formed at an end portion of each elastic arm 332. A distance between each elastic arm 332 and the inner surface of the base plate 30 is greater than a distance between the main body 331 and the inner surface of the base plate 30.

A guiding sheet 34 is positioned between each of the fixing sheets 31, 32 and a corresponding one of the elastic arms 332. Each guiding sheet 34 includes an upright connecting portion 341 extending substantially perpendicularly from the inner surface of the base plate 30, and a top wall 342 bent from a top edge of the connecting portion 341. An elastic finger 35 is positioned between each of the fixing sheets 31, 32 and the corresponding elastic arm 332. The elastic fingers 35 protrude from the inner surface of the base plate 30, and an elastic point 36 is formed on each elastic finger 35. In the illustrated embodiment, the fixing sheets 31, 32, the elastic sheet 33, the guiding sheets 34, the elastic fingers 35, and the elastic points 36 are integrally formed with the inner surface of the base plate 30.

The speaker includes a fixing plate 43 to fix onto the base plate 30. Two through holes 41 are positioned at two corners adjacent of a lower portion of the fixing plate 43. The fixing plate 43 slides along the guiding sheets 34 until two corners of a top portion of the fixing plate 43 are received in the fixing sheets 31, 32. The elastic fingers 35 resist two side edges of the fixing plate 43 to prevent the speaker 40 from moving forward and backward. The salient points 333 pass through the through holes 41. The lower portion of the fixing plate 43 compresses the elastic sheet 33 to resist the lower portion of the fixing plate 43, thereby fixing the speaker 40 on the base plate 30.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

What is claimed is:

1. A mounting apparatus for mounting a speaker to a computer case, the mounting apparatus comprising:

a base plate assembled on the computer case;

a fixing member configured to fix two corners of a top edge of the speaker; and an elastic sheet configured to fix a bottom edge of the speaker, wherein the two corners are received in the fixing member, and the bottom edge of the speaker elastically compresses the elastic sheet; the elastic sheet elastically resists the bottom edge of the speaker to mount the speaker to the base plate.

2. The mounting apparatus of claim 1, wherein the fixing member comprises two fixing sheets positioned at an angle on a surface of the base plate.

3. The mounting apparatus of claim 2, further comprising two guiding sheets positioned between each fixing sheet and elastic arm respectively, wherein the speaker slides into the mounting apparatus along the guiding sheets which fix two side edges of the speaker.

4. The mounting apparatus of claim 3, wherein each guiding sheet comprises an upright connecting portion extending substantially perpendicularly from the surface of the base plate, and a top wall bent from a top edge of the connecting portion.

5. The mounting apparatus of claim 2, further comprising two elastic fingers positioned between each fixing sheet and elastic arm respectively, wherein a salient point is positioned on each elastic finger; the elastic fingers resist the side edges of the speaker through the elastic points and the speaker is mounted to the base plate.

6. The mounting apparatus of claim 5, wherein the fixing sheets, the elastic sheet, the guiding sheets, the elastic fingers, and the elastic points are integrally formed with the base plate.

7. The mounting apparatus of claim 1, wherein the elastic sheet comprises a main body, and a pair of elastic arms extending from opposite sides of the main body; a salient point is positioned on each elastic arm.

8. A mounting apparatus for mounting a speaker to a base plate, the mounting apparatus comprising:

a fixing member configured to fix two corners of a top edge of the speaker; and an elastic sheet configured to fix a bottom edge of the speaker, wherein the two corners are received in the fixing member, and the bottom edge of the speaker elastically compresses the elastic sheet; the elastic sheet elastically resists the bottom edge of the speaker to mount the speaker to the base plate.

9. The mounting apparatus of claim 8, wherein the elastic sheet comprises a main body, and a pair of elastic arms extending from opposite sides of the main body; two salient points are positioned on each elastic arm.

10. The mounting apparatus of claim 8, wherein the fixing member comprises two fixing sheets positioned at an angle on a surface of the base plate.

11. The mounting apparatus of claim 10, further comprising two guiding sheets positioned between each fixing sheet and elastic arm respectively, wherein the speaker slides into the mounting apparatus along the guiding sheets which fix two side edges of the speaker.

12. The mounting apparatus of claim 11, wherein each guiding sheet comprises an upright connecting portion extending substantially perpendicularly from the surface of the base plate, and a top wall bent from a top edge of the connecting portion.

13. The mounting apparatus of claim 10, further comprising two elastic fingers positioned between each fixing sheet and elastic arm respectively, wherein a salient point is positioned on each elastic finger; the elastic fingers resist the side edges of the speaker through the elastic points and the speaker is mounted to the base plate.

14. The mounting apparatus of claim 13, wherein the fixing sheets, the elastic sheet, the guiding sheets, the elastic fingers, and the elastic points are integrally formed with the base plate.

* * * * *